US007417410B2

(12) United States Patent
Clark, III et al.

(10) Patent No.: US 7,417,410 B2
(45) Date of Patent: Aug. 26, 2008

(54) METHOD AND APPARATUS FOR POWER CONTROL

(76) Inventors: Howard G. Clark, III, 5032 N. Vadalez St., Las Vegas, NV (US) 89149; Howard G. Clark, IV, 9128 Ripple Ridge, #103, Las Vegas, NV (US) 89149

( * ) Notice: Subject to any disclaimer, the term of this patent is extended or adjusted under 35 U.S.C. 154(b) by 234 days.

(21) Appl. No.: 11/267,231

(22) Filed: Nov. 3, 2005

(65) Prior Publication Data

US 2007/0097716 A1 May 3, 2007

(51) Int. Cl.
*G05F 3/16* (2006.01)

(52) U.S. Cl. ..... 323/223

(58) Field of Classification Search ..... 323/223, 323/234; 315/209 R, 226, 239, 282, 287, 315/291

See application file for complete search history.

(56) References Cited

U.S. PATENT DOCUMENTS 4,728,866 A 3/1988 Capewell et al.
4,956,583 A 9/1990 Lawrence et al.
5,434,478 A 7/1995 Kovalsky et al.
6,525,490 B1 * 2/2003 Rinaldi ..... 315/291
6,657,404 B1 12/2003 Clark et al.
2003/0114963 A1 * 6/2003 Walker ..... 700/291
2007/0057640 A1 * 3/2007 Chung et al. ..... 315/209 R

* cited by examiner

*Primary Examiner*—Adolf Berhane
(74) *Attorney, Agent, or Firm*—Robert D. Atkins; Quarles & Brady LLP

(57) ABSTRACT

A power control system includes a power reduction module operable to reduce power to a connected load, a switching module operable to selectively transfer power directly to the load or to the power reduction module, a harmonic reduction module connected to an output of the power reduction module for reducing signal harmonics from power transferred to the load, a controller linked to the switching module to provide control signals, a resistor coupled between the switching module and the power reduction module, and a resistor voltage monitor coupled between the switching module and the resistor, wherein the resistor voltage monitor measures a voltage across the resistor and sends voltage measurement data to the controller. A method for a power control system to reduce power consumption of a load is also disclosed.

19 Claims, 4 Drawing Sheets

FIG. 3
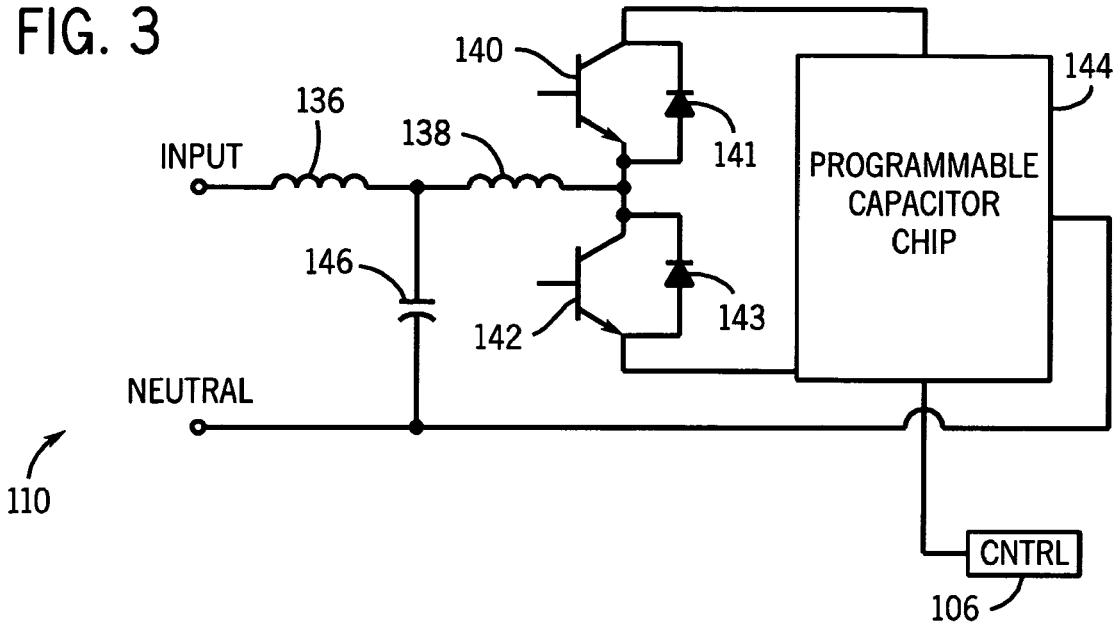
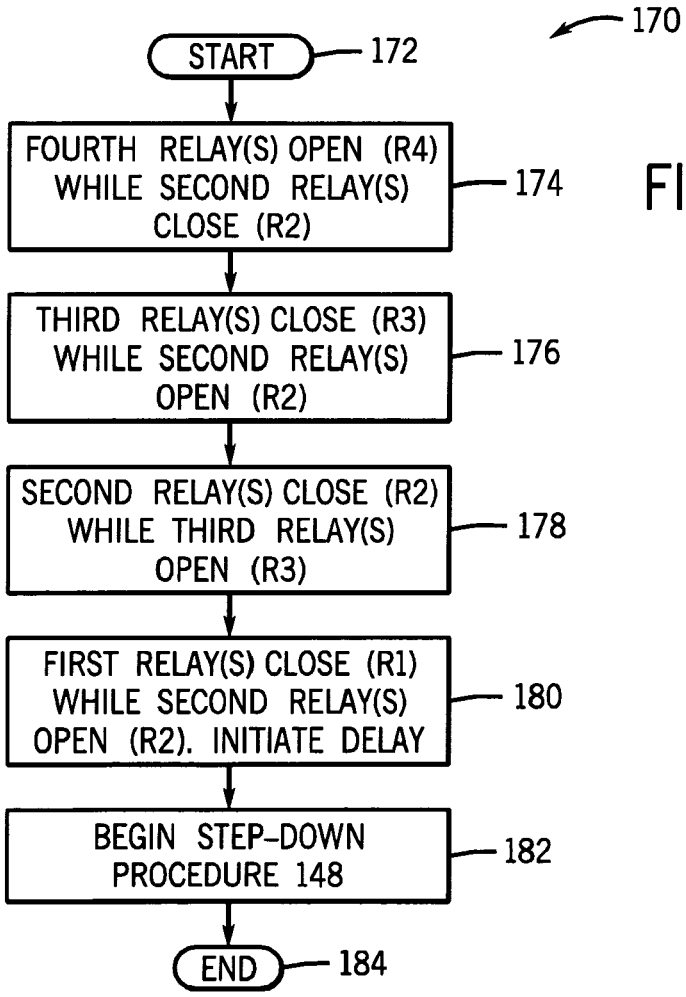
FIG. 5

METHOD AND APPARATUS FOR POWER CONTROL

FIELD OF THE INVENTION

The present invention relates in general to power systems and, more particularly, to a method and apparatus to reduce power consumption of lighting systems or other loads.

BACKGROUND OF THE INVENTION

As can be understood, there are numerous reasons to reduce power consumption of a lighting or other electrical system. The benefits include reduced power costs to the user and benefits to the environment. While it may be desirable to reduce an electrical system's power consumption, it is preferred to not reduce or hinder operation of the electrical system. By way of example, a lighting system's power consumption can be reduced by dimming the lights, but reducing power consumption may undesirably reduce the light output of the lighting system. The lighting system was likely installed and designed for a predetermined amount of input power or voltage and hence, reducing the amount of the voltage defeats the purpose of the lighting systems.

It is known, however, that certain types of electrical systems can be provided less power without hindering operation. In the case of lighting systems, it is known in the prior art that high intensity discharge (HID) and fluorescent lighting systems can be operated at a lower voltage after operation for a short time at full power. Power savings through dimming can be realized without an appreciable amount of reduced light output. For example, the change in light output can not be detected by the human eye.

While it is desirable to reduce power consumption in lighting or other electrical systems by reducing the voltage supplied to the systems reliable and dependable, operation must be maintained. In one example installation, HID and fluorescent lighting can be installed in a parking lot, parking garage, or building interior. If the power saving systems malfunction, the lights can be rendered inoperable. A malfunction could create an undesirable and dangerous environment. In other instances, the lights can facilitate business transactions. If the lighting system illuminates an automobile parking lot or the interior of a business establishment, an inoperable lighting system could result in lost profits and a reduction in market share. Customer goodwill and reputation can also be damaged.

As a drawback to prior art systems, the combination of running a load at voltage levels near the minimum voltage level for continued operation and use of the voltage modifying devices, such as a transformer, can create unreliable operation. In some instances unwanted signal components are introduced into the power signal which disrupt operation. In the case of power reduction system configured with transformers, signal components can be introduced that disrupt desired operation. In addition, the power reduction systems generally lack any fail safe mechanisms to protect the system and ensure reliable operation.

Thus, a need exists for a power reduction system which effectively reduces voltage levels to a desired level for a period of time while ensuring consistent and reliable operation of an associated load. In addition, a need exists for the reduction and/or elimination of unwanted signal components which can be introduced during the voltage reduction operation while consistent operation of the system is maintained.

SUMMARY OF THE INVENTION

In one embodiment, the present invention is a power control system, comprising a power reduction module operable to reduce power to a connected load, a switching module operable to selectively transfer power directly to the load or to the power reduction module, a harmonic reduction module connected to an output of the power reduction module for reducing signal harmonics from power transferred to the load, a controller linked to the switching module to provide control signals, a resistor coupled between the switching module and the power reduction module, and a resistor voltage monitor coupled between the switching module and the resistor, wherein the resistor voltage monitor measures a voltage across the resistor and sends voltage measurement data to the controller.

In another embodiment, the present invention is a system for reducing power consumed by a load, comprising a controller operable to generate a first control signal, a power reduction module operable to reduce an amount of the power provided to the load, a relay, responsive to the first control signal, configured to selectively activate the power reduction module for reducing the amount of power provided to the load, and a first voltage monitor coupled to an input of the power reduction module operable to transmit first voltage data to the controller, wherein the controller does not activate the power reduction module until after the first voltage data has been received.

In another embodiment, the present invention is a method for a power control system to reduce power consumption of a load, comprising closing a first relay to provide power to a load, measuring an input voltage of the system, opening the first relay while closing a second relay to provide power to a power reduction module, the power reduction module having a stepped down output connected to a third relay, and opening the second relay while closing the third relay, wherein the third relay selectively controls power flow from the stepped down output to the load.

In still another embodiment, the present invention is a method of manufacturing a system for reducing power consumed by a load, comprising providing a controller operable to generate a first control signal, providing a power reduction module operable to reduce an amount of the power provided to the load, providing a relay, responsive to the first control signal, configured to selectively activate the power reduction module for reducing the amount of power provided to the load, and providing a first voltage monitor coupled to an input of the power reduction module operable to transmit first voltage data to the controller, wherein the controller does not activate the power reduction module until after the first voltage data has been received.

BRIEF DESCRIPTION OF THE DRAWINGS

FIG. 3 illustrates an example component of a harmonic reduction or filter module for use in a power control system;

FIG. 5 illustrates a second example method of operation of a power control system;

DETAILED DESCRIPTION OF THE DRAWINGS

Figure 1:
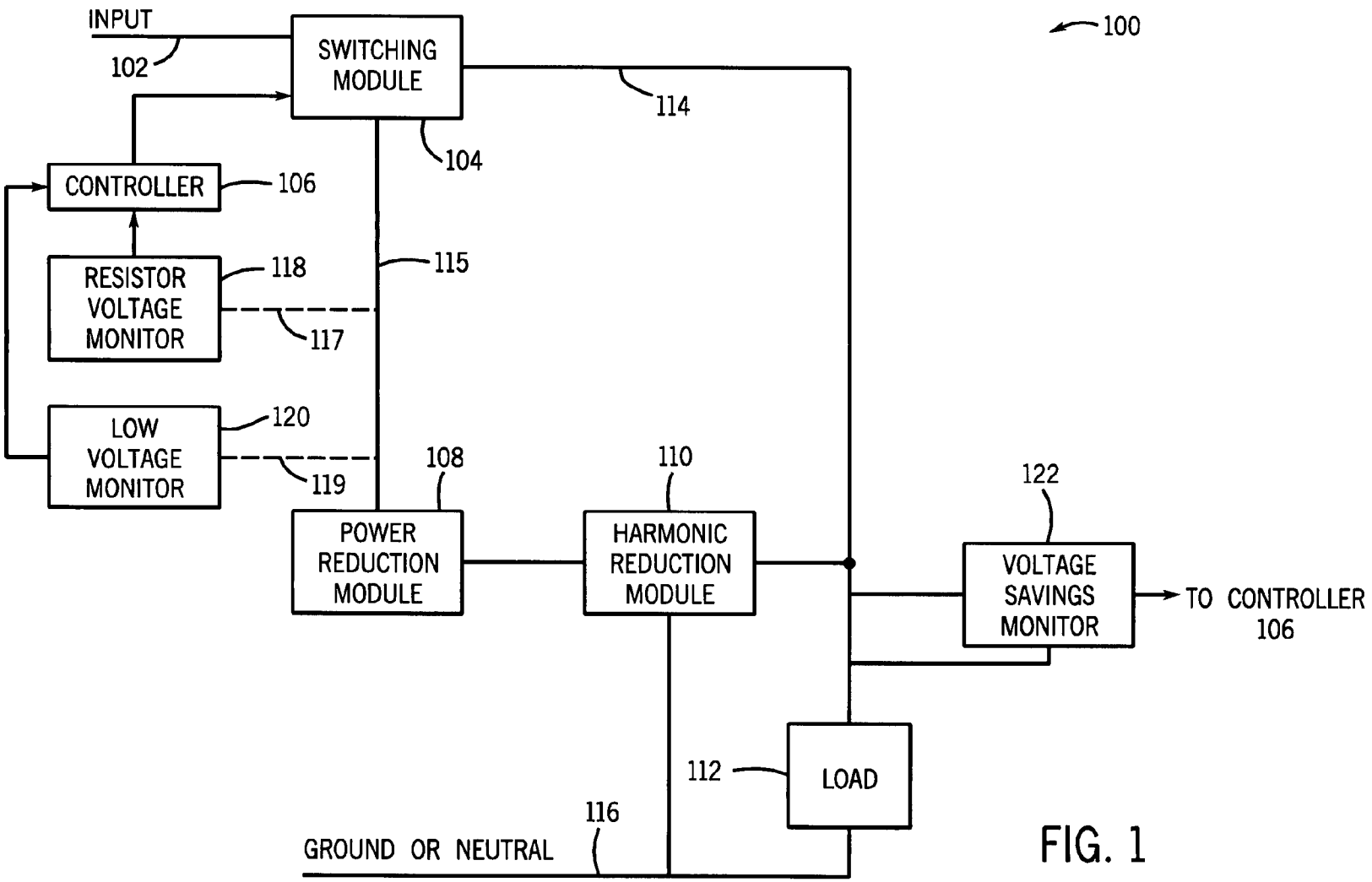
FIG. 1 illustrates a block diagram of an example power control system.

The present invention is described in one or more embodiments in the following description with reference to the Figures, in which like numerals represent the same or similar elements. While the invention is described in terms of the best mode for achieving the invention's objectives, it will be appreciated by those skilled in the art that it is intended to cover alternatives, modifications, and equivalents as can be included within the spirit and scope of the invention as defined by the appended claims and their equivalents as supported by the following disclosure and drawings.

Many of the functional units described in this specification have been labeled as modules, in order to more particularly emphasize their implementation independence. For example, a module can be implemented as a hardware circuit comprising custom VLSI circuits or gate arrays, off-the-shelf semiconductors such as logic chips, transistors, or other discrete components. A module can also be implemented in programmable hardware devices such as field programmable gate arrays, programmable array logic, programmable logic devices or the like.

Modules can also be implemented in software for execution by various types of processors. An identified module of executable code can, for instance, comprise one or more physical or logical blocks of computer instructions which can, for instance, be organized as an object, procedure, or function. Nevertheless, the executables of an identified module need not be physically located together, but can comprise disparate instructions stored in different locations which, when joined logically together, comprise the module and achieve the stated purpose for the module.

Indeed, a module of executable code can be a single instruction, or many instructions, and can even be distributed over several different code segments, among different programs, and across several memory devices. Similarly, operational data can be identified and illustrated herein within modules, and can be embodied in any suitable form and organized within any suitable type of data structure. The operational data can be collected as a single data set, or can be distributed over different locations including over different storage devices, and can exist, at least partially, merely as electronic signals on a system or network.

Reference throughout this specification to "one embodiment," "an embodiment," or similar language means that a particular feature, structure, or characteristic described in connection with the embodiment is included in at least one embodiment or example of the present invention. Thus, appearances of the phrases "in one embodiment," "in an embodiment," and similar language throughout this specification can, but do not necessarily, all refer to the same embodiment.

Reference to a signal bearing medium can take any form capable of generating a signal, causing a signal to be generated, or causing execution of a program of machine-readable instructions on a digital processing apparatus. A signal bearing medium can be embodied by a transmission line, a compact disk, digital-video disk, a magnetic tape, a Bernoulli drive, a magnetic disk, a punch card, flash memory, integrated circuits, or other digital processing apparatus memory device.

Reference to service can include any conceivable service offering associated with analysis, design, implementation, or utilization of the disclosed apparatus, system, or method. A service can additionally include but is not limited to rental, lease, licensing, and other offering, contractual or otherwise, of hardware, software, firmware, network resources, data storage resources, physical facilities, and the like. Services can additionally include physical labor, consulting, and other offerings of physical, intellectual, and human resources.

The schematic flow chart diagrams included are generally set forth as logical flow chart diagrams. As such, the depicted order and labeled steps are indicative of one embodiment of the presented method. Other steps and methods can be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types can be employed in the flow chart diagrams, they are understood not to limit the scope of the corresponding method. Indeed, some arrows or other connectors can be used to indicate only the logical flow of the method. For instance, an arrow can indicate a waiting or monitoring period of unspecified duration between enumerated steps of the depicted method. Additionally, the order in which a particular method occurs can or can not strictly adhere to the order of the corresponding steps shown.

Furthermore, the described features, structures, or characteristics of the invention can be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

A method and apparatus for controlling power distribution to a load is disclosed. In the embodiment described below, the load can include a light or lighting system. The method and apparatus for control power described can control a variety of lighting systems, including HID, low-pressure sodium, fluorescent, iridescent, metal halide, mercury vapor, and high-pressure sodium systems. However, the method and apparatus described below can be applied to any number of situations where the power supply to a load is desired to be controlled, as will be seen.

Turning to FIG. 1, an example block diagram of a power control system 100 is shown. An input 102 connects to a switching module 104. The input 102 receives an input power supply to be provided to a load 112. In addition to the switching module receiving an input power supply with a line voltage, the switching module 104 also receives a low voltage control input from a controller device 106. Switching module 104 is connected to a power reduction module 108, a harmonic reduction module 110, and to the load 112. The opposing side of the load 112 connects to a ground or neutral 116. The system described in FIG. 1 can be configured in single or three phase. As such, ground or neutral 116 can also be configured to be a secondary input 102 for a particular application.

Switching module 104 can include any type of device configured to switch power output between conductors 114 and 115. In various examples the switching module 104 includes a relay, switch, contacts, resistors, capacitors, or any other type of switching system. The switching of the power or signal in the input 102 can occur instantaneously or close thereto, concurrently, or as part of a progressive fade in transfer of the output between conductors 114 and 115. Hence, for a period, both conductors 114, 115 may be energized. The controller 106 which connects to switching module 104 is configured to control the time at which the switching module 104 switches/toggles and the rate at which switching occurs. Controller 106 can include a timer which operates based on the time of day or based on other factors. Controller 106 can also include a variety of programmable devices or components or can be externally connected to a remote computer system, as will be seen.

As discussed above, the load 112 can include any type of load 112 whose supplied power could be reduced with a corresponding degree of savings while the overall operational integrity of the load 112 is maintained. In one example, the load 112 includes a lamp, lamp fixture, or lighting system. To reduce or otherwise modify power consumption by the load 112, the example of FIG. 1 as shown includes the power reduction module 108 and the harmonic reduction module 110. The power reduction module includes any type of system or device capable of reducing the amount of power provided to the load 112 when power is diverted by the switching module 104 to travel through the power reduction module 108. In one example, the power reduction module 108 includes a commonly obtained step-down transformer. In other examples, power reduction module 108 includes a transformer, motor controller contactors, resistors, timers, general duty delay, switches, and lights. Power reduction module 108 can also include various components such as capacitors, resistors, variable or programmable capacitors, solid state contactors, and trisistors.

Power control system 100 includes a harmonic reduction module 110. The harmonic reduction module 110 can perform signal processing on the output of the power reduction module 108 to provide an improved signal to the load 112. In one example, the harmonic reduction module 110 includes a pass filter having a cut off frequency selected to remove unwanted harmonics or frequency components. Harmonic reduction module 110 can include a capacitor sized to remove unwanted signal components. In some instances, failure to remove unwanted frequency components from the signal after power reduction can result in undesirable operation of the load 112. Power reduction module 108 and harmonic reduction module 110 can connect to ground or neutral 116 as necessary to achieve desired results as previously described.

In one example, input 102 includes a 60 hertz power signal and load 112 includes HID-type lamps or fixtures. After an initial warm up phase, the power provided on the input 102 can be switched from directly going to the load 112 to run through the power reduction module 108. Reduction of the voltage by the power reduction module 108 can introduce harmonics into the signal provided to load 112. As a result of the harmonics, the level of power provided to the load 112 can undesirably drop below the minimum required power level necessary to maintain operation of the load 112. Inclusion of harmonic reduction module 110 helps to alleviate the harmonics and ensure proper and reliable operation of the load 112.

Power control system 100 includes additional components. A resistor voltage monitor 118, low voltage monitor 120, and voltage savings monitor 122 are illustrated. As shown, a sensor lead 117 is connected between resistor voltage monitor 118 and conductor 115. Additionally, a sensor lead 119 is shown connected between low voltage monitor 120 and conductor 115. Monitors 118,120,122 are intended to be powered by a separate power supply than from input 102. Monitors 118,120,122 form an external system apart from the main power conducting channels 114 and 115. The monitors work independently to measure operational parameters of the system 100 and provide information to controller 106 or elsewhere. In the event of a power disruption in system 100 (e.g., a loss of input 102 power), monitors 118,120 and 122 can be provided with a battery backup, an uninterrupted power supply (UPS) or similar means to continue to operate and relay operational information to the appropriate destination.

Monitors 118,120,122 can be connected to controller 106 by a signal bearing medium which can carry information such as a control signal between monitors 118,120,122 and controller 106. Additionally, monitors 118,120,122 can include an input-output (I/O) port or similar means to communicate with an external computer system (not shown). The external computer system can be coupled between the controller 106 and the various monitors 118,120,122.

Resistor voltage monitor 118 and low voltage monitor 120 add an additional level of reliability to the operation of power control system 100. Resistor voltage monitor 118, low voltage monitor 120 and voltage savings monitor 122 can be configured to work in conjunction with controller 106 by providing a stream of data which discloses the operating parameters of the power control system 100 to controller 106 or to an external computer system. Depending on the nature of the data received, controller 106 can implement predefined operating procedures of the system 100 or can be instructed to implement the predefined operating procedures through an external system.

In one example, resistor voltage monitor 118 monitors the voltages across a resistor or set of resistors which are incorporated into the system 100. If resistor voltage monitor 118 detects the appropriate potential across the resistor(s) in a preliminary first step, resistor voltage monitor 118 can then notify controller 106 or an external system that the system 100 is able to begin implementing the power reduction process. Low voltage monitor 120 similarly monitors voltages as part of the overall system 100. If a situation arises where voltages drop to an undesired low level, low voltage monitor 120 can act to notify controller 106 or an external system of the problem. As a result, controller 106 can implement a predefined/preprogrammed recovery procedure which is intended to allow the voltage(s) across the load 112 to increase to an appropriate level to ensure operability of the load 112.

Voltage savings monitor 122 also can work in conjunction with controller 106 or a similar component in the system 100. In one example, voltage savings monitor 122 monitors the actual voltage(s) being supplied to the load 112 and compares the actual voltage with a predetermined/preprogrammed line voltage as supplied to input 102 to determine a difference voltage. Over a period of time, the difference voltage can be multiplied with the time period and a cost coefficient of electricity to determine the overall monetary savings as a result of the implementation of system 100.

Consider an example method A of operation of the method and apparatus described herein. Method A begins when the operation provides power to the power control system 100. Providing power may occur by actuating a switch or relay as part of switching module 104. It may be desirable to locate a relay or switch between the power source 102 and the transformer or other power reduction modules 108. As a result, power may not be continually provided through conductor 115. In some configurations the transformer or other power reduction modules 108 may draw power even when the load 112 is not energized. Consequently, disconnecting the transformer or other power control devices from the power source 102 during periods when the load 112 is not in use may result in additional power savings.

As a next step in example method A, the operation provides full power to the load 112 to initiate desired operation of the load 112. The load 112 generally requires full power during an introductory start-up period. After the introductory start-up period the power, i.e. voltage or current, supplied to the load 112 may be reduced without significantly affecting operation of the load 112. Timing or monitoring of the load 112 or some attribute of the load 112 may occur to determine when operation power provided to the load 112 may be reduced. In addition, monitors 118 or 120 can monitor the operational health of the system 100 to determine whether it is safe to proceed with a power reduction operation as is now described.

As a next step, the operation checks voltage across resistors located as part of system 100 using the resistor voltage monitor 118. If a voltage is seen across the resistors, controller 106 is notified by resistor voltage monitor 118 that the system 100 is operational and able to begin the power reduction operation or process. Controller 106 can then begin diverting power as provided directly to the load to a power reduction module 108 and/or harmonic reduction module 110. The diversion of power may occur rapidly or over a period of time to achieve a smooth transition that does not interfere with desired operation of the load. One or more circuits or power supply systems may be introduced to achieve a desired transition.

As a next step, a harmonic reduction operation occurs by harmonic reduction module 110 to reduce harmonics that may be created by the power reduction step. In one embodiment, signal aspects other than harmonics are reduced or eliminated. As a next step, a reduced amount of power is provided to the load 112 as compared to the amount or level of power provided at a previous step in the operation. The load 112 continues to operate in a desired manner even at reduced power level and the load operates consistently as a result of the harmonic reduction or other signal improvement that occurs. This is but one possible method of operation that benefits from the harmonic reduction operation or other power signal modification methods discussed herein. It is contemplated that one of ordinary skill in the art may derive other methods of operation that do not depart from the scope of the invention.

Figure 2:
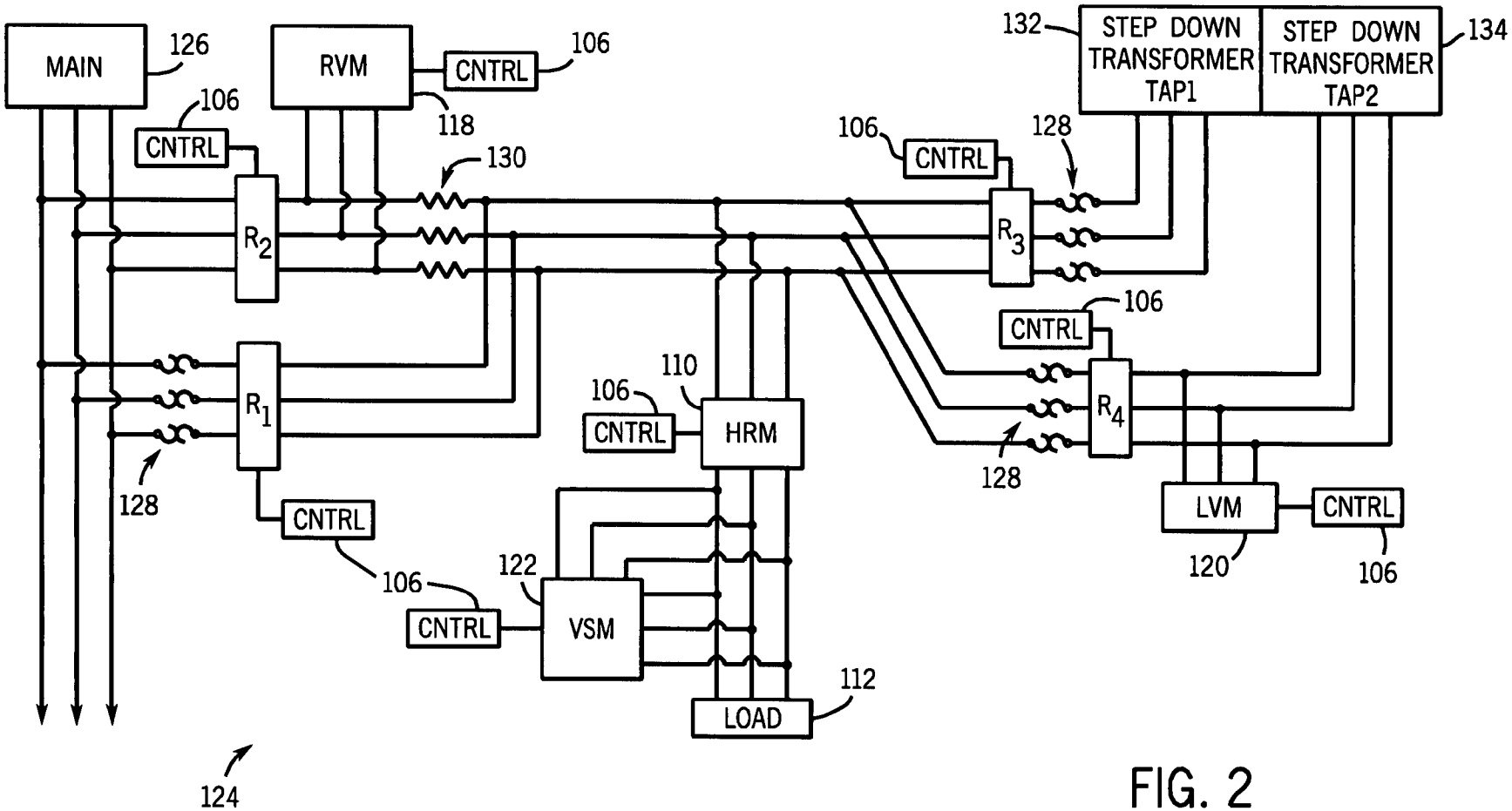
FIG. 2 illustrates a three phase application of an example power control system.

FIG. 2 illustrates an example block diagram of a three-phase power control system 124. Power is supplied from a main power source 126. Four sets of relays, designated as R1, R2, R3 and R4 are shown in various parts of the system 124. Relays R1, R2, R3, R4 are shown connected to a controller 106. Again, controller 106 can include any hardware, software, or a combination of hardware and software implementations in order to cause relays R1, R2, R3, R4 to function. Relays R1, R2 are shown connected in parallel with main power source 126. A set of fuses 128, one for each phase, protects the input terminals to relays R1. Resistor voltage monitor (RVM) 118 is shown connected to the output terminals of relays R2. Also connected to the output terminals of relays R2 are a set of resistors 130, again one for each phase. RVM 118 is also linked to controller 106 to send and receive operating information for system 126.

The output of a first tap 132 of a step-down transformer is connected to fuses 128. The output terminals of fuses 128 are connected to the input terminals of relays R3. Likewise, the output of a second tap 134 of the step-down transformer is shown connected to the terminals of relays R4. Also shown connected to the terminals of relays R4 is low voltage monitor (LVM) 120 with an accompanying connection to controller 106 and fuses 128. Connected to the junction of the terminals R1, R2, R3, R4 is a harmonic reduction module (HRM) 110 with an accompanying connection to controller 106. VSM 122 makes a closed loop with the output terminals of HRM 110 to read a C-Type (CT) voltage and calculate voltage savings. VSM 122 also has a corresponding link with controller 106 to send information to controller 106 in order for the information to be displayed to a user. Finally, load 112 is shown connected to the output terminals of HRM 110.

Relays R1, R2, R3, R4 are shown as relays for purposes of understanding. Devices other than relays can be utilized including switches, magnetic contacts, manual switches, resistors, trisistors, capacitors, fuseblocks, and phase monitors. The first tap 132 and second tap 134 of the transformer comprise a first step-down transformer tap 132 and second step-down transformer tap 134 configured to step down or reduce the voltage provided at the first tap 132 or second tap 134 as compared to the voltage level at the power source 126. It is intended that a voltage level taken at the first tap 132 is generally higher than a voltage level taken at the second tap 134.

Controller 106 can include a programmable logic controller (PLC) or similar microprocessor-based industrial control system. Controller 106 can communicate with other process control components through various data links as part of system 100, system 126, or an external system, again as previously described. Hence, it is contemplated that controller 106 can include a local controller, a remote controller, or a combination of both local and remote controller systems. A remote controller portion can comprise a computer system located externally from system 124 in order to provide for redundancy, a similar benefit, or simply for ease of installation. Controller 106 can be used in process control for simple switching tasks, Proportional-Integral-Derivative (PID) control, complex data manipulation, arithmetic operations, timing and process and machine control of system 100 or 126.

An example implementation of controller 106 can include an accompanying graphical user interface (GUI) which can indicate operational information to a user. An associated GUI can include such devices as liquid-crystal display (LCD) screens, light-emitting diodes (LEDs) or similar visual and/or auditory components. A master override switch, master reset switch, or similar components can also be associated with controller 106 so that in the event of a power failure, the system 100 or 126 can be bypassed or shut down. The master override switch or reset switch can include a manual on/off function where a user can turn the system 124 off manually if desired.

Controller 106 can include various communications channels in order to provide notification to a user of the operational status of system 100. For example, a telephone link can connect controller 106 with an external communications network, computer system or similar. Controller 106 can use the telephone link to notify external customers in the event of a system 100 malfunction.

Turning to FIG. 3, an example depiction of Harmonic Reduction Module (HRM) 110 is shown. HRM 110 can be implemented in a single-phase configuration or as a three-phase (per leg as shown) configuration. An input is coupled to a first coil 136 of an auto transformer or step-down transformer. A center tap connects first coil 136 with a second coil 138. An output of coil 138 is shown connected to transistor 140 and diode 141, shown connected in parallel. Transistor 142 and diode 143 are also shown connected in parallel. The transistor/diode combinations 140,141 and 142,143 are connected in series with a programmable capacitor chip 144. Programmable capacitor chip 144 is coupled to controller 106, which allows controller 106 to control various operating parameters of programmable capacitor chip 144 such as impedance or operational capacitance. An output of chip 144 is shown connected to neutral. Again, since HRM 110 can be implemented in a variety of single or three phase applications, it is possible for the neutral to be used as an additional second input to the HRM 110. Use of HRM 110 can reduce or eliminate the need for increased neutral sizes or K value transformer requirements.

In contrast to earlier harmonic reduction systems that provided harmonic signal processing to balanced loads, HRM 110 allows system 100 or 124 to reduce power to both balanced and unbalanced loads. HRM 110 can be designed for specific load requirements. Any frequency cut-off point can be achieved through selection of the appropriate capacitor value. HRM 110 can comprise an active filter which uses various power electronics such as those illustrated in the example embodiment to reduce or cancel signal harmonics from the load(s) 112.

Figure 4:
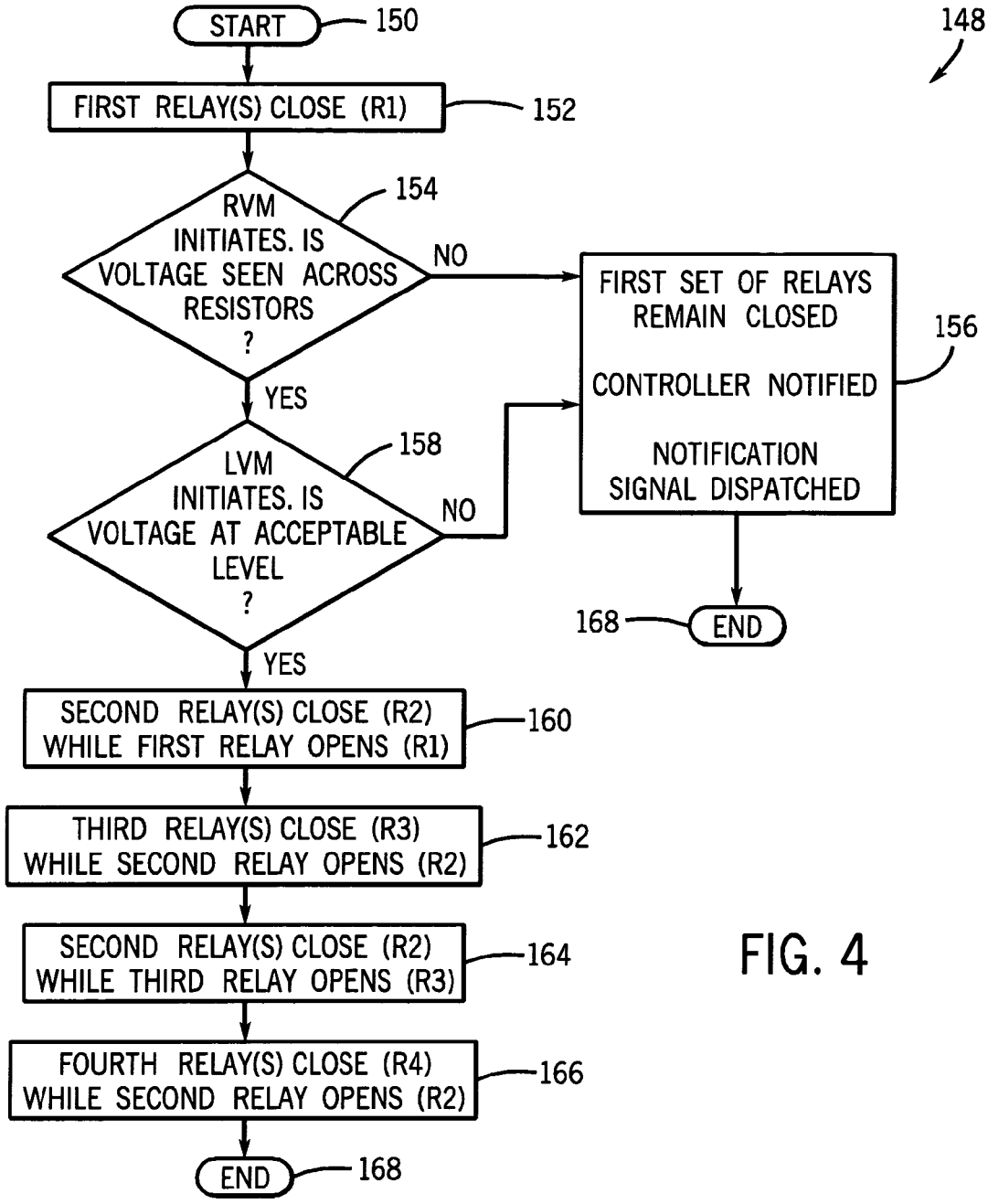
FIG. 4 illustrates an example method of operation of a power control system.

FIG. 4 illustrates an example power reduction method 170 of system 124. Method 148 begins with start step 150. As a next step 152, a first relay or set of relays (R1) close in response to a control signal received from controller 106. The resistor voltage monitor 118 then initiates a predefined initialization function. The function queries whether a voltage is seen across resistor(s) 130 in step 154. If the result of step 154 is negative, the controller 106 is able to determine that resistors 130 have been damaged, e.g., by a spike in power supplied by the main power supply 126 or otherwise. As a result, the first set of relays remain closed, controller 106 is notified and, after a predefined delay, a notification signal is dispatched from controller 106 to an external location in step 156. In one example, the predefined delay can be 60 minutes of elapsed time.

If the result of query 154 is positive (i.e., voltage is seen across the resistors 130), the LVM 120 initiates a predefined initialization procedure. LVM 120 then queries whether a measured voltage is at an accepted predefined level. Again, the predefined initialization procedure performed by LVM 120 is designed to check the system 124 to see if the system 124 has been damaged by a spike in power, short circuited or otherwise not functioning normally. For example, LVM may measure a voltage to determine if the voltage is within predefined accepted parameters of the system 124. If the initialization procedure carried out by LVM 120 is acceptable, the controller 106 is notified. Controller 106 then begins to carry out a predefined step-down procedure to reduce power to the load 112.

The step-down procedure begins with a second relay or set of relays closing (R2) while the first relay or set of relays opens (R1) in step 160. The procedure of closing a relay or set of relays while opening a relay or set of relays is performed in such a manner that power distribution is uninterrupted to load 112. For example, closing/opening relay operation can be completed in a matter of milliseconds or microseconds. As a result, the power supplied to load 112 is uninterrupted; continuous power is provided to load 112 at all times during an example operation.

Relays R2 are intended to function as an intermediate action or vehicle, ensuring that power is continuously provided to load 112 between switching operations that close relays connected to power reducing components of the system 124. Returning to the example method 148, a third relay or set of relays close (R3) while the second relay(s) open (R2) in step 162. Step 162 allows power to flow from an output terminal of the step-down transformer providing reduced power to the load 112. As a next intermediate step 164, the second relay(s) again close (R2) while the third relay opens (R3). Again, the intermediate actions of closing/opening the second relay(s) and a successive operation of closing/opening power reduction relays R3, R4 are completed in such a way as to not disrupt power transmission or significantly increase or decrease voltage applied to load 112 during the intermediate actions. The intermediate actions can be again performed in a matter of milliseconds or microseconds.

As a next step 166, a fourth relay or set of relays close (R4) while the second relay(s) open (R2). The output power from step-down transformer tap 2 is intended to be lower than that of the output of step-down transformer tap 1. As such, the power provided to load 112 at step 166 is intended to be the target reduced power to be applied to load 112. Step 184 ends the step-down process.

In addition to performing the above power reduction steps, additional step-down activities involving additional system components such as additional step-down transformers can be performed as necessary to implement a power reduction scheme required for a certain load or situation. Controller 106 can additionally be programmed to not implement one or more steps of the example method 148 to tailor the power reduction to a given scenario.

During an operation of the power reduction system 124, LVM 120 can continuously monitor an output voltage being supplied to load 112 to ensure that the power is consistently being supplied to load 112. If the measured voltage drops to a level lower than a predefined level, LVM 120 can send the measured voltage data or a similar communications signal to controller 106 to notify controller 106 of the situation. Controller 106 (again, comprising a local controller, remote controller, or a combination of both local and remote controllers) can then take steps to increase voltage to the system.

An example recovery activity is illustrated in FIG. 5. Recovery method 170 begins with start step 172. The fourth relay(s) (R4) then is instructed to open while the second relay(s) (R2) closes as an intermediate step 174. The third relay(s) (R3) then closes in step 176 while the second relay(s) (R2) opens. As a result of step 176, the voltage is incrementally stepped up. The second relay(s) (R2) again closes in step 178 as an intermediate step while the third relay(s) (R3) opens. The first relay(s) then closes (R1) in step 180 while the second relay(s) (R2) opens. Again, as a result of step 180, the voltage supplied to load 112 is incrementally stepped up.

Controller 106 then initiates a predetermined delay, allowing the greater voltage into the system for a predetermined period of time. In one embodiment, the predetermined delay can be programmed into controller 106 to be an hour in duration. The predetermined delay can allow various components in the power reduction system 100 to be evaluated by controller 106 or by various other modules or components. The predetermine delay can allow a communications signal sent by controller 106 to an external source to be posted, reviewed, or allow time for a technician to respond. Finally, the predetermined delay can help to take into account a sagging main power supply that may need time to increase to an appropriate voltage level. After the predetermined delay has expired, the method 170 initiates step 182 to begin the step-down procedure 148 once again. Step 184 ends the recovery method 170.

Figure 6:
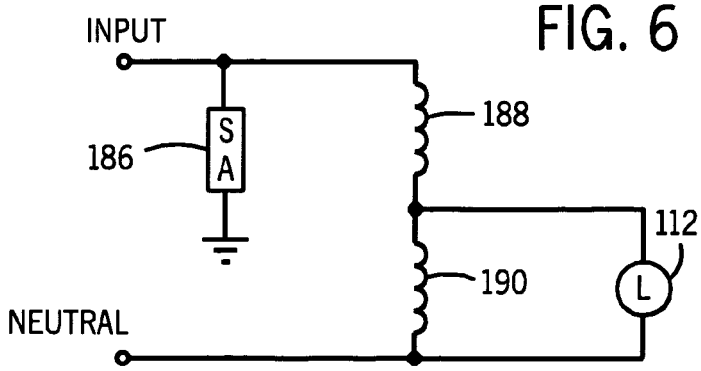
FIG. 6 illustrates an example surge arresting component of a power control system.

Turning to FIG. 6, an additional feature of system 100 or system 124 is illustrated. Surge arrester 186 is seen coupled between an input and ground. Surge arrester 186 comprises any protective device for limiting surge voltages by discharging or bypassing surge current. Surge arrester 186 also prevents continued flow of follow current while remaining capable of repeating the function of limiting surge voltages. Surge arrester 186 can be again seen in a single phase or three phase (per leg as shown) implementation. A first coil 188 of an auto transformer or step-down transformer is coupled to a second coil 190 via a center tap. Load 112 is coupled between the center tap and an output of second coil 190. The node connecting the output of second coil 190 and load 112 is then connected to neutral or ground.

Again, as previously described, the method and apparatus of power control exemplified in systems 100 and 124 can be applied to any number of situations where the power supply to a load is desired to be controlled. For example, a power control system can be implemented where the load 112 includes a heater for a plastic molding machine. In a typical scenario, the plastic molding machine can necessitate a higher amount of startup voltage and/or current to heat to a desired temperature. After the desired temperature is reached, however, it is not necessary to supply a continued amount of full voltage to the heater to maintain operation. A series of calculations which depend on various manufacturing parameters can be utilized to form a predetermined operation schedule which can be programmed into controller 106. As such, the controller 106 can operate relays R1, R2, R3, R4 as necessary to cause the appropriate stepped-down voltage to reach the heater at the appropriate time in a manufacturing operation, yet save power by providing an overall reduced average voltage over time.

In a second example, load 112 can include a conveyor system for crushing rocks or a similar operation. Again, a much larger startup voltage is generally required to generate the necessary torque to the motors operating the conveyor belt. Once the startup torque is obtained and the motors are turning at the desired revolutions-per-minute (RPMs), the voltage applied to the conveyor motors can then be stepped-down to an appropriate operating voltage. Monitors 118 and 120 can be configured such that a sudden increase in the load (e.g., heavier rock or larger friction in the system) can be relayed to controller 106 in a matter of milliseconds or microseconds. Controller 106 can then quickly implement (again in a matter of fractions of a second) a predefined operational schedule which can include opening and closing relays R1, R2, R3, R4 as necessary to quickly provide additional operating voltage or lesser operating voltage as needed.

In addition to providing reduced power to street lighting systems and other loads 112 at predefined voltages (i.e., 120, 208, 240, 277 or 480 volts), the present apparatus and system can provide reduced power to obtain a target operational voltage at any voltage level.

While one or more embodiments of the present invention have been illustrated in detail, the skilled artisan will appreciate that modifications and adaptations to those embodiments can be made without departing from the scope of the present invention as set forth in the following claims.

What is claimed is:

1. A power control system, comprising:

a power reduction module operable to reduce power to a load;

a switching module operable to selectively transfer power directly to the load or to the power reduction module;

a harmonic reduction module connected to an output of the power reduction module for reducing signal harmonics from power transferred to the load;

a controller linked to the switching module;

a resistor coupled between the switching module and the power reduction module;

a resistor voltage monitor coupled to first and second terminals of the resistor, wherein the resistor voltage monitor measures a voltage across the resistor and sends voltage measurement data to the controller; and a low voltage monitor coupled between the power reduction module and the load, wherein the low voltage monitor measures a voltage across the load and transmits voltage measurement data to the controller, and the controller provides control signals to the switching module after comparing the voltage across the resistor to a first value and after comparing the voltage across the load to a second value.

2. The system of claim 1, wherein the controller renders the switching module inoperable to transfer power to the power reduction module unless a predefined voltage measurement is first obtained by the resistor voltage monitor.

3. The system of claim 1, wherein the harmonic reduction module further includes a programmable capacitor chip for varying a desired operating capacitance.

4. The system of claim 1, wherein the harmonic reduction module further includes a capacitor to filter the signal harmonics.

5. The system of claim 1, wherein the power reduction module further includes a step-down transformer for reducing the power.

6. The system of claim 1, further including a surge arrester coupled to an input of the switching module for preconditioning the power.

7. The system of claim 1, further including a voltage savings module coupled between the harmonic reduction module and the load for calculating a voltage savings.

8. A system for reducing power consumed by a load, comprising:

a controller operable to generate control signals;

a power reduction module operable to reduce an amount of the power provided to the load;

a relay, responsive to a first control signal, configured to selectively activate the power reduction module for reducing the amount of power provided to the load;

a first voltage monitor coupled to an input of the power reduction module operable to measure and transmit first voltage data to the controller, wherein the controller compares the first voltage data to a value and activates the power reduction module; and a second voltage monitor coupled between the power reduction module and the load operable to transmit second voltage data to the controller, wherein receipt of the second voltage data causes the controller to send a second control signal to the relay.

9. The system of claim 8, further including a harmonic reduction module coupled between the power reduction module and the second voltage monitor for reducing signal harmonics of the power.

10. The system of claim 8, further including a surge arrester coupled to an input of the switching module for preconditioning the power.

11. The system of claim 8, further including a voltage savings module coupled between the harmonic reduction module and the load for calculating a voltage savings.

12. A method for a power control system to reduce power consumption of a load, comprising:

closing a first relay to provide power to the load;

measuring an input voltage of the power control system;

comparing the measured input voltage to a pre-defined value;

generating a control signal in response to the comparison of the measured input voltage to the pre-defined value;

opening the first relay while closing a second relay to provide power to a power reduction module, the power reduction module having a stepped down output connected to a third relay; and opening the second relay while closing the third relay, wherein the third relay selectively controls power flow from the stepped down output to the load.

13. The method of claim 12, wherein opening the first relay while closing the second relay is performed so as to cause an uninterrupted flow of power to the load.

14. The method of claim 12, wherein the load is unbalanced.

15. The method of claim 12, further including removing signal harmonics from the power provided to the load.

16. The method of claim 12, further including measuring a voltage savings obtained from a difference of a voltage across the first relay and a voltage taken from an output of the power reduction module over a period of time.

17. A method of manufacturing a system for reducing power consumed by a load, comprising:

providing a controller operable to generate a first control signal;

providing a power reduction module operable to reduce an amount of the power provided to the load;

providing a relay, responsive to the first control signal, configured to selectively activate the power reduction module for reducing the amount of power provided to the load; and providing a first voltage monitor coupled to an input of the power reduction module operable to measure and transmit first voltage data to the controller, wherein the controller does not activate the power reduction module until after receiving the first voltage data and comparing the first voltage data to a predefined value.

18. The method of claim 17, further including providing a second voltage monitor coupled between the power reduction module and the load operable to transmit second voltage data to the controller, wherein receipt of the second voltage data causes the controller to send a second control signal to the relay.

19. The method of claim 17, further including providing a harmonic reduction module coupled between the power reduction module and the second voltage monitor for reducing signal harmonics of the power.

* * * * *